US009279280B1

(12) United States Patent
Chen et al.

(10) Patent No.: US 9,279,280 B1
(45) Date of Patent: Mar. 8, 2016

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Cheng-Chieh Weng, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/471,163

(22) Filed: Aug. 28, 2014

(51) Int. Cl.
*A47B 88/04* (2006.01)
*E05D 15/06* (2006.01)
*A47B 88/12* (2006.01)

(52) U.S. Cl.
CPC ..... *E05D 15/0621* (2013.01); *A47B 88/04* (2013.01); *A47B 88/12* (2013.01)

(58) Field of Classification Search
CPC .... A47B 88/04; A47B 88/12; A47B 2088/04; A47B 2210/0064; A47B 2210/007; A47B 2210/0081
See application file for complete search history.

(56) References Cited

U.S. PATENT DOCUMENTS

| | | | | |
|---|---|---|---|---|
| 5,551,775 | A * | 9/1996 | Parvin | A47B 88/10 312/334.11 |
| 6,997,529 | B1 | 2/2006 | Chen et al. | |
| 7,413,269 | B2 * | 8/2008 | Chen | A47B 88/10 312/333 |
| 8,303,052 | B2 * | 11/2012 | Chen | A47B 88/10 312/319.1 |
| 2002/0057042 | A1 * | 5/2002 | Milligan | A47B 88/08 312/334.46 |
| 2005/0017614 | A1 * | 1/2005 | Cirocco | A47B 88/08 312/333 |
| 2005/0248247 | A1 * | 11/2005 | Huang | A47B 88/16 312/334.47 |
| 2011/0280506 | A1 * | 11/2011 | Chen | F16C 29/046 384/10 |
| 2012/0308297 | A1 * | 12/2012 | Chen | A47B 88/08 403/109.2 |

* cited by examiner

*Primary Examiner* — Daniel Rohrhoff
(74) *Attorney, Agent, or Firm* — Rosenberg, Klein & Lee

(57) ABSTRACT

A slide rail assembly includes a first rail having a guiding portion, a second rail, a third rail having a hook portion, and an actuating member movably connecting to the second rail and having a contact portion. When the third rail is pulled with respect to the first rail with the contact portion engaging with the hook portion, the second rail synchronously moves along with the third rail to be moved to a predetermined position with respect to the first rail, and consequently, the actuating member rotates by an angle by guiding means of the guiding portion of the first rail to disengage the contact portion of the actuating member from the hook portion of the third rail.

16 Claims, 18 Drawing Sheets

SLIDE RAIL ASSEMBLY

FIELD OF THE INVENTION

The present invention relates to a slide rail assembly, and more particularly, to a slide rail assembly of which two rails may be synchronously moved and when one of the rails is moved to a position, the rail may be remained at the position while the other rail may be further moved forward.

BACKGROUND OF THE INVENTION

Generally speaking, a server chassis is mounted on a rack by means of a pair of slide rail assemblies in server systems. The slide rail assembly is usually in a form constituted by two or three sections of rails to carry the server chassis. The difference is that three-section rails have longer extension lengths to meet actual specific requirements.

Among the technologies of three-section rails, the engagement between rails or the synchronous movement between rails along an extending direction has been common developed technologies, which also means that such related technologies have already become specific operational and commercial requirements. For example, U.S. Pat. Nos. 7,413,269 B2 and 6,997,529 B1 disclosed the engagement between engaging blocks and engaging holes (or engaging grooves) to ensure the positioning between rails and the synchronous movement.

SUMMARY OF THE INVENTION

The present invention is a slide rail assembly of which two rails may be synchronously moved and when one of the rails is moved to a position, the rail may be remained at the position while the other rail may be further moved forward.

An aspect of the present invention provides a slide rail assembly comprising a first rail, a second rail, an actuating member, and a third rail. The first rail comprises a guiding portion. The second rail is longitudinally and movably connected to the first rail. The actuating member is movably connected to the second rail and comprises a contact portion. The third rail is longitudinally and movably connected to the second rail and comprises a hook portion. When the third rail is pulled with respect to the first rail with the contact portion of the actuating member engaging with the hook portion of the third rail, the second rail is synchronously moved along with the third rail. When the second rail is moved to a predetermined position with respect to the first rail, the actuating member rotates by an angle by guiding means of the guiding portion of the first rail and thereby disengages the contact portion of the actuating member from the hook portion of the third rail.

Preferably, the guiding portion of the first rail comprises a horizontal section and an inclining section extending from the horizontal section. When the second rail is moved to the predetermined position with respect to the first rail, the actuating member is guided from the horizontal section to the inclining section and thereby rotates by the angle to disengage the contact portion of the actuating member from the hook portion of the third rail. The guiding portion further comprises a blocking wall adjacent to the inclining section to further block the contact portion of the actuating member after the actuating member is guided from the horizontal section to the inclining section.

Preferably, the second rail comprises a protrusion portion and the slide rail assembly further comprises a fixing member connected to the second rail. The fixing member comprises a contact section corresponding to the protrusion portion of the second rail and the actuating member further comprises a tail portion located between the contact section of the fixing member and the protrusion portion of the second rail.

Preferably, the slide rail assembly further comprises a swinging member pivotally connected to the first rail and comprising a leg portion, wherein the second rail comprises an indention portion for the leg portion to press against; and an assisting member comprising an elastic guiding portion contacting the swinging member. When the second rail moves to the predetermined position, the swinging member presses the leg portion against the indention portion of the second rail by an elastic force generated by the elastic guiding portion.

Preferably, the second rail has a first end portion and a second end portion opposite to the first end portion. The fixing member and the actuating member are adjacent to the first end portion of the second rail. The slide rail assembly further comprises an engaging member adjacent to the second end portion of the second rail, wherein the engaging member comprises a positioning portion. The third rail further comprises an opening corresponding to the positioning portion of the engaging member so that the positioning portion of the engaging member engages with and positions at the opening of the third rail when the third rail moves with respect to the second rail to an extended position. The engaging member comprises a base plate and an elastic portion bending from the base plate, wherein the positioning portion is located at the elastic portion. The slide rail assembly further comprises at least one restricting member attached to the second rail; and a releasing member mounted to the second rail and comprising a moving portion and a disengaging portion, wherein one of the moving portion and the disengaging portion comprises at least one longitudinal groove corresponding to the at least one restricting member, and wherein the disengaging portion corresponds to a portion of the swinging member. When the releasing member is pulled with respect to the at least one restricting member after engagement of the leg portion of the swinging member with the indention portion of the second rail, the swinging member is moved by means of the disengaging portion of the releasing member to disengage the leg portion of the swinging member from the indention portion of the second rail.

Another aspect of the present invention provides a slide rail assembly comprising a first rail, a second rail, a swinging member, and an assisting member. The second rail is longitudinally and movably connected to the first rail and comprises an indention portion. The swinging member is pivotally connected to the first rail and comprises a leg portion corresponding to the indention portion of the second rail. The assisting member is adjacent to the swinging member and comprises an elastic guiding portion contacting the swinging member. When the second rail moves to a predetermined position with respect to the first rail, the swinging member pivots in response to an elastic force generated by the elastic guiding portion to engage the leg portion of the swinging member with the indention portion of the second rail so that the second rail is positioned with respect to the first rail.

Another aspect of the present invention provides a slide rail assembly comprising a first rail, a second rail, a fixing member, an actuating member, a third rail, and a swinging member. The first rail comprises an upper wall, a lower wall, and a longitudinally extending body extending between the upper wall and the lower wall of the first rail, wherein the longitudinally extending body comprises a guiding portion comprising a horizontal section, an inclining section extending from the horizontal section, and a blocking wall adjacent to the inclining section. The second rail is longitudinally and movably connected to the first rail and comprises an upper wall, a lower wall, a longitudinally extending body extending between the upper wall and the lower wall of the second rail, and a protrusion portion located at the longitudinally extending body of the second rail, wherein one of the upper wall and the lower wall comprises an indention portion. The fixing member is connected to the second rail and comprises a contact section corresponding to the protrusion portion of the second rail. The actuating member is movably connected to the second rail and comprises a contact portion corresponding to the guiding portion of the first rail and a tail portion located between the contact section of the fixing member and the protrusion portion of the second rail. The third rail is longitudinally and movably connected to the second rail and comprises a hook portion corresponding to the contact portion of the actuating member. When the third rail is moved along an extending direction with the contact portion of the actuating member correspondingly engaging with the hook portion of the third rail, the second rail is synchronously moved along with the third rail. When the second rail is moved to a position corresponding to the guiding portion of the first rail, the contact portion of the actuating member is successively guided by the horizontal section and the inclining section of the guiding portion of the first rail. When the contact portion of the actuating member is guided by the inclining section, the actuating member rotates by means of the tail portion pressing against the contact section of the fixing member so that the contact portion of the actuating member disengages from the hook portion of the third rail and is then guided to and blocked by the blocking wall of the guiding portion. The swinging member is movably connected to the longitudinally extending body of the first rail and comprises a leg portion corresponding to the indention portion of the second rail, wherein when the second rail is synchronously moved along with the third rail to a predetermined position along the extending direction, the leg portion of the swinging member enters the indention portion of the second rail.

Preferably, the second rail has a first end portion and a second end portion opposite to the first end portion. The fixing member and the actuating member are adjacent to the first end portion of the second rail. The slide rail assembly further comprises an engaging member adjacent to the second end portion of the second rail, wherein the engaging member comprises a positioning portion and the third rail further comprises an opening corresponding to the positioning portion of the engaging member so that the positioning portion of the engaging member engages with and positions at the opening of the third rail when the third rail moves with respect to the second rail to a position. The engaging member comprises a base plate and an elastic portion bending from the base plate, and wherein the positioning portion is located at the elastic portion.

Preferably, the slide rail assembly further comprises at least one restricting member attached to the second rail; and a releasing member mounted to the longitudinally extending body of the second rail and adjacent to the indention portion of the second rail. The releasing member comprises a moving portion and a disengaging portion, wherein one of the moving portion and the disengaging portion comprises at least one longitudinal groove corresponding to the at least one restricting member, and wherein the disengaging portion corresponds to a portion of the swinging member. When the moving portion is operated after engagement of the leg portion of the swinging member with the indention portion of the second rail, the disengaging portion is driven to move the portion of the swinging member so that the leg portion of the swinging member is disengaged from the indention portion of the second rail again.

Preferably, the third rail further comprises a guiding slant adjacent to the hook portion. When the third rail is retracted along a retracting direction, the contact portion of the actuating member is pressed back to engage with the hook portion of the third rail by the guiding slant of the third rail. The indention portion of the second rail comprises a slant. When the third rail is retracted along the retracting direction, the slant presses against the leg portion of the swinging member so that the leg portion deviates and leaves the indention portion of the second rail.

Preferably, the slide rail assembly further comprises an operating member connected to the third rail to be operated to move the third rail along the extending direction. The longitudinally extending body of the first rail comprises a fixing portion. The operating member comprises a base plate portion connected to the third rail, an elastic plate bending from the base plate portion for providing an elastic force, and a handle portion connected to the elastic plate. The elastic plate comprises an engaging portion corresponding to the fixing portion of the longitudinally extending body of the first rail. When the third rail is retracted to a retracted position with respect to the first rail, the engaging portion of the elastic plate engages with the fixing portion by the elastic force provided by the elastic plate.

A feature of the embodiments of invention is that when the third rail is moved along the extending direction, the second rail synchronously moves along with the third rail in the extending direction, and the second rail may temporarily remain at a position without moving along with the third rail when the position is arrived at, while the third rail may continue to move along the extending direction.

DETAILED DESCRIPTION OF THE INVENTION

Figure 1:
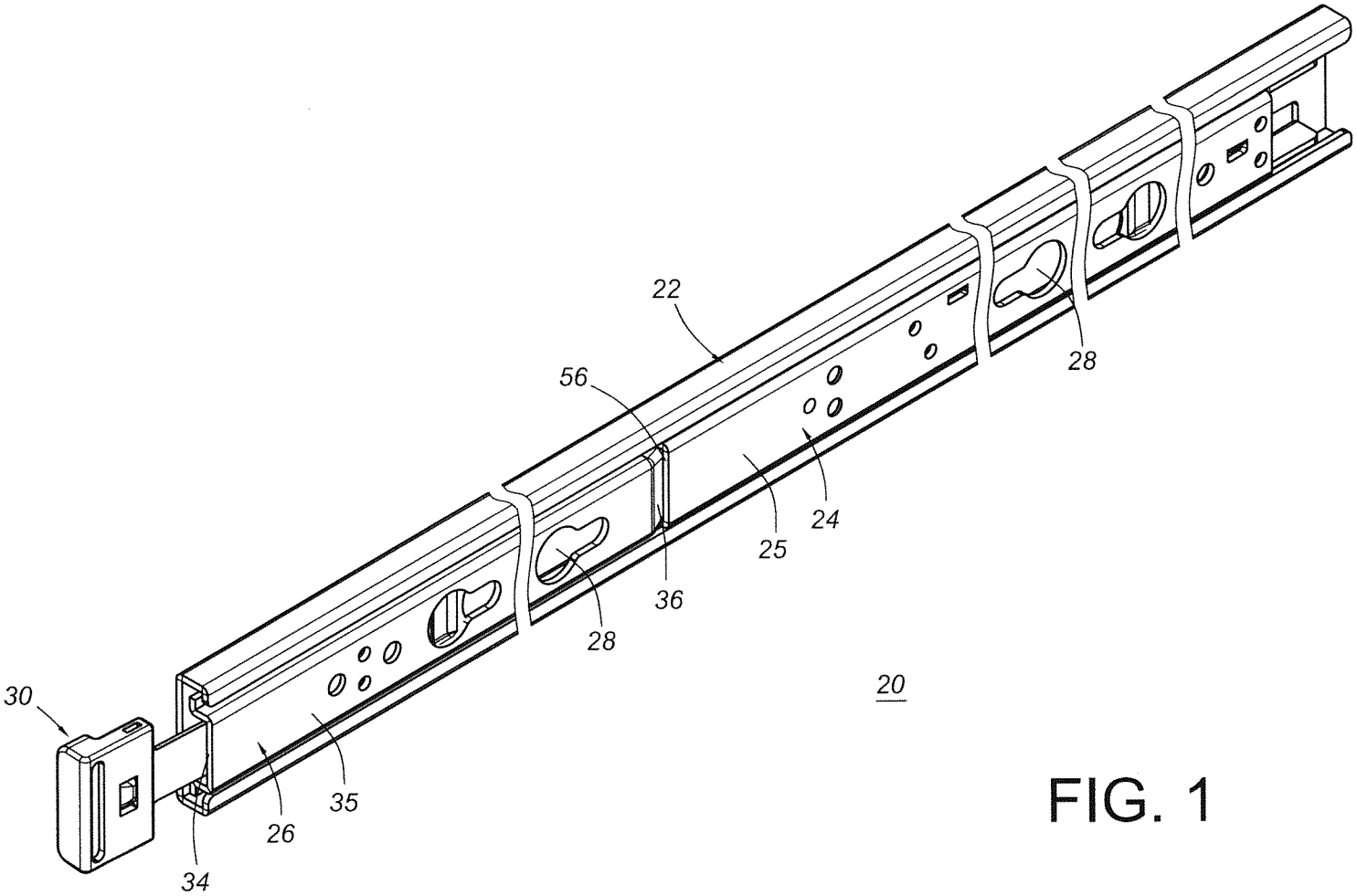
FIG. 1 shows a perspective view of a slide rail assembly in accordance with an embodiment of the present invention.

FIG. 1 shows a slide rail assembly 20 comprising a first rail 22, a second rail 24, and a third rail 26 at a retracted state according to an embodiment of the present invention. The second rail 24 and the third rail 26 may be longitudinally moved with respect to the first rail 22. Preferably, the second rail 24 and the third rail 26 each comprises at least one mounting portion 28 for mounting a chassis (such as a server chassis). Preferably, an operating member 30 is connected to the third rail 26 and configured to be operated to move the third rail 26 along an extending direction.

Figure 2:
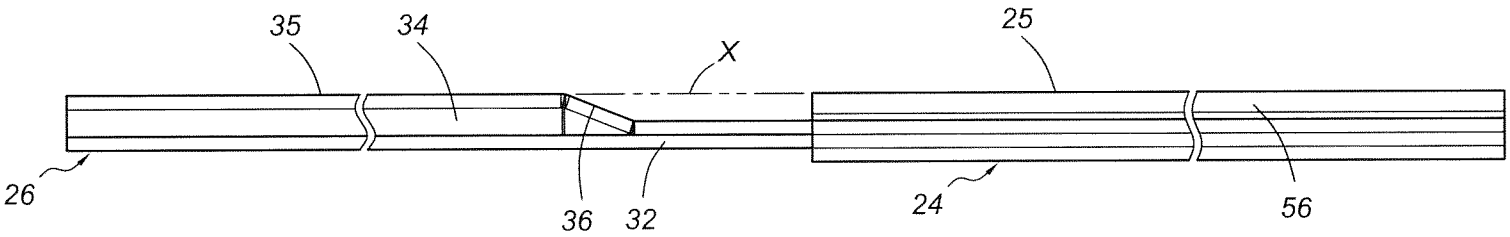
FIG. 2 is a schematic view of the second rail and the third rail in FIG. 1, wherein the second rail and the third rail are assemble to each other, and wherein the third rail is pulled from the second rail by a distance.

Referring to FIG. 1 and FIG. 2, FIG. 2 shows the third rail 26 comprising a first longitudinal portion 32, a second longitudinal portion 34, and a slant portion 36 connected between the first longitudinal portion 32 and the second longitudinal portion 34. The first longitudinal portion 32 of the third rail 26 is movably connected to the inside of the second rail 24, and the second longitudinal portion 34 of the third rail 26 extends from the slant portion 36 to be located outside the second rail 24.

As shown in FIG. 2, the second rail 24 comprises a longitudinally extending body 56 comprising a lateral side 25, and the second longitudinal portion 34 of the third rail 26 comprises a lateral side 35. The lateral side 35 of the second longitudinal portion 34 of the third rail 26 and the lateral side 25 of the longitudinally extending body 56 of the second rail 24 are substantially in a same reference plane X (the reference plane X is a fictitious plane, and the present invention is not limited thereto) by means of the slant portion 36. Each of the second rail 24 and the third rail 26 thereby may be mounted with a chassis, wherein the two chassis have substantially identical widths. In addition, the slant portion 36 of the third rail 26 may contact against the second rail 24 (as shown in FIG. 1).

Figure 3:
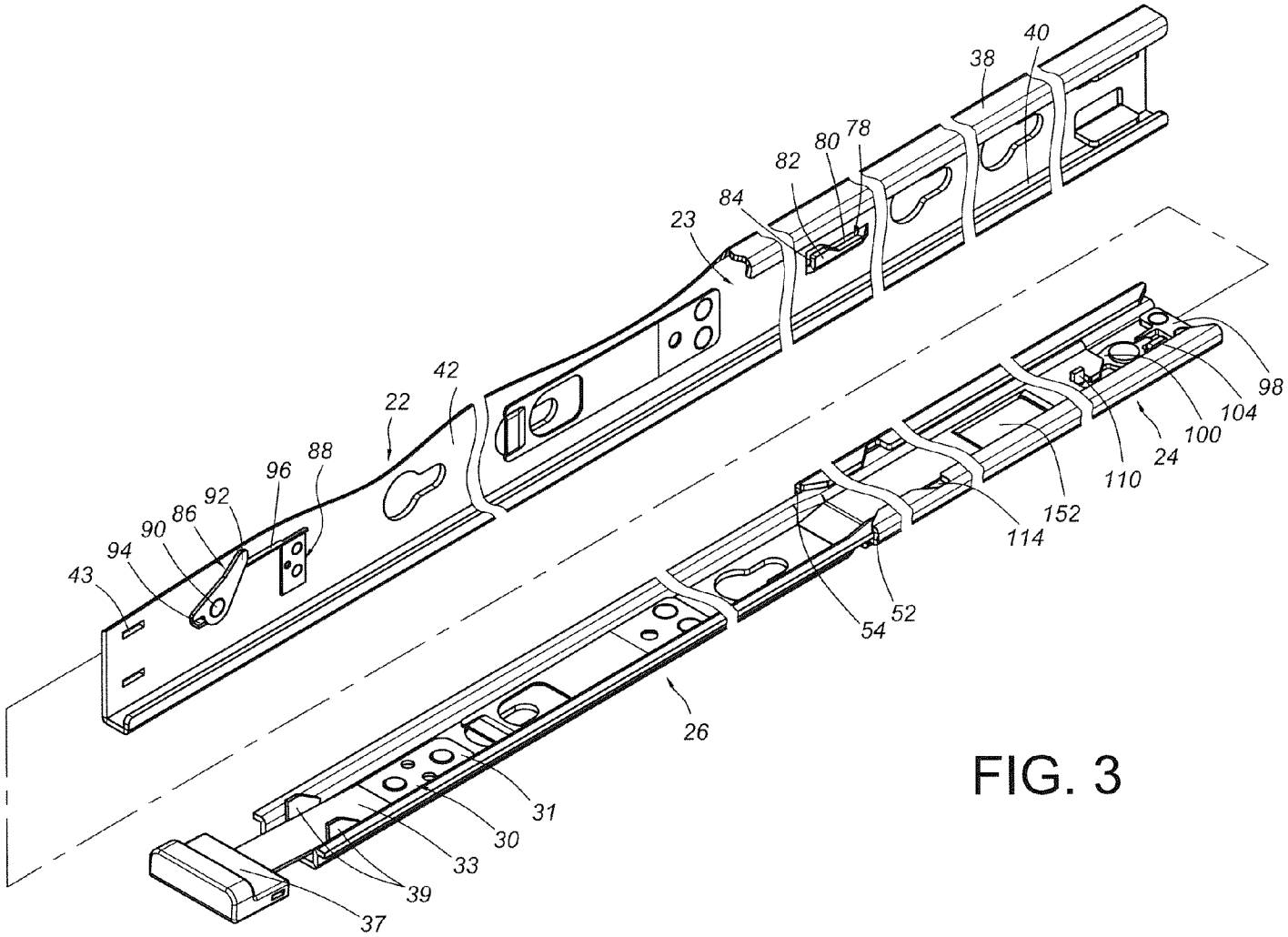
FIG. 3 is a schematic exploded view of the first rail and the assembled second rail and third rail of the slide rail assembly in accordance with an embodiment of the present invention.

FIG. 3 shows the first rail 22 separated from the assembled second rail 24 and third rail 26.

The first rail 22 comprises an upper wall 38, a lower wall 40, and a longitudinally extending body 42 extending between the upper wall 38 and the lower wall 40, wherein the upper wall 38, the lower wall 40, and the longitudinally extending body 42 collectively define a first longitudinal channel 23. The longitudinally extending body 42 of the first rail 22 comprises a guiding portion 78, and more particularly, the guiding portion 78 is integrated with the longitudinally extending body 42 of the first rail 22, but the present invention is not limited thereto. The guiding portion 78 comprises a horizontal section 80, an inclining section 82 extending from the horizontal section 80, and a blocking wall 84 adjacent to the inclining section 82. Moreover, the longitudinally extending body 42 of the first rail 22 further comprises at least one fixing portion 43. In a preferred embodiment, the longitudinally extending body 42 of the first rail 22 comprises two fixing portions 43 which are holes (as in FIG. 3), but the present invention is not limited thereto.

The slide rail assembly 20 further comprises a swinging member 86 and an assisting member 88, wherein the swinging member 86 is movably connected to the longitudinally extending body 42 of the first rail 22. Preferably, the swinging member 86 is pivotally connected to the longitudinally extending body 42 of the first rail 22 by means of a first connection member 90. The swinging member 86 comprises a leg portion 92 and an extended side portion 94. The assisting member 88 is connected to the longitudinally extending body 42 of the first rail 22 and adjacent to the swinging member 86 and comprises a longitudinally extending elastic guiding portion 96, wherein the elastic guiding portion 96 of the assisting member 88 contacts the leg portion 92 of the swinging member 86.

Figure 4:
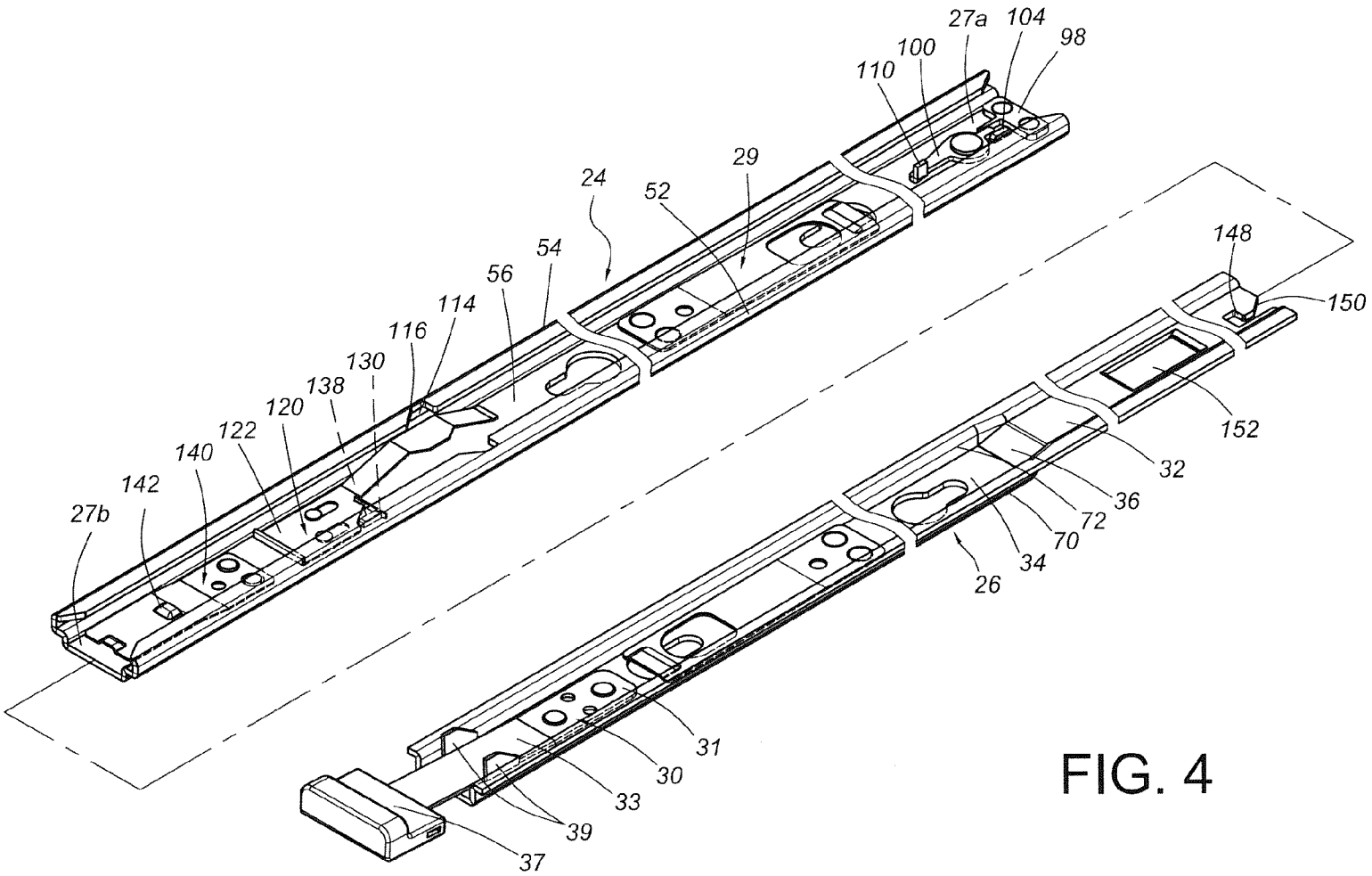
FIG. 4 is a schematic exploded view of the second rail and the third rail of the slide rail assembly in accordance with an embodiment of the present invention.

Referring to FIG. 3 and FIG. 4, FIG. 4 shows the second rail 24 separated from the third rail 26.

The second rail 24 is longitudinally and movably connected to the first rail 22, and more particularly, the second rail 24 is received in and movable along the first longitudinal channel 23 of the first rail 22. The second rail 24 comprises an upper wall 52, a lower wall 54, and a longitudinally extending body 56 extending between the upper wall 52 and the lower wall 54, wherein the upper wall 52, the lower wall 54, and the longitudinally extending body 56 collectively define a second longitudinal channel 29. The longitudinally extending body 56 of the second rail 24 comprises a first end portion 27*a* and a second end portion 27*b* opposite to the first end portion 27*a*. The second rail 24 further comprises a protrusion portion 104 located at the longitudinally extending body 56. The slide rail assembly 20 further comprises a fixing member 98 and an actuating member 100 which are connected to the second rail 24. In a preferred embodiment, the fixing member 98 and the actuating member 100 are adjacent to the first end portion 27*a* of the second rail 24.

Figure 5:
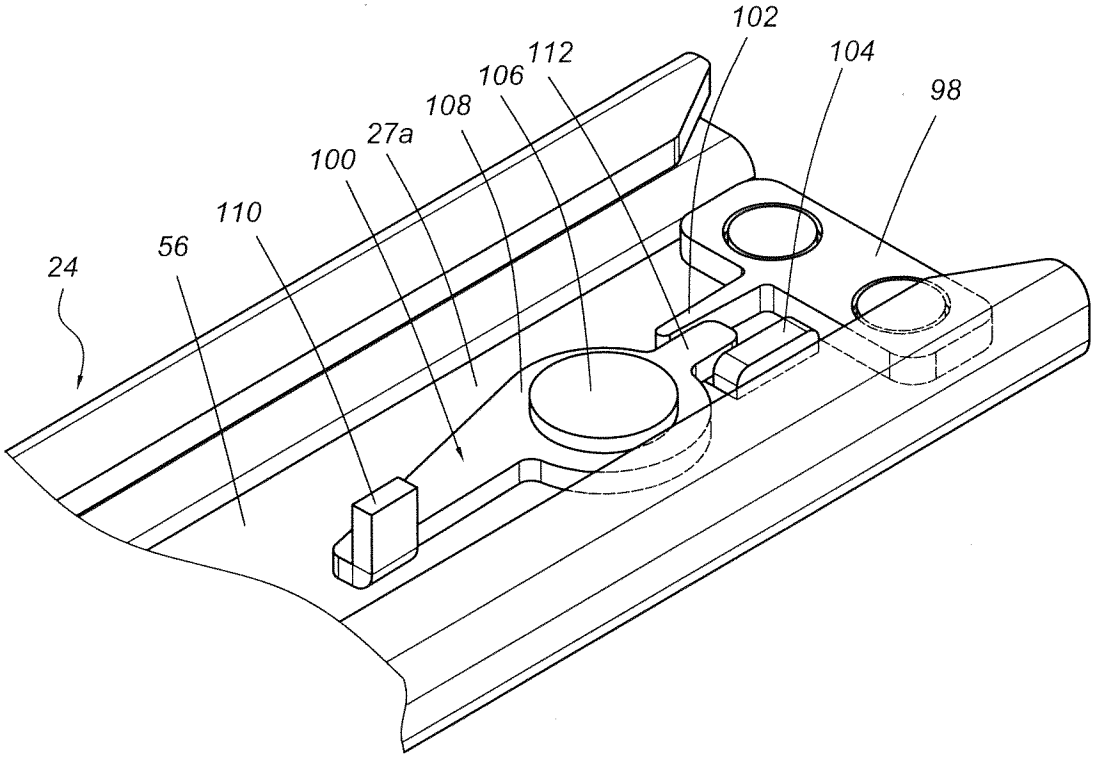
FIG. 5 is a detailed schematic view of a portion of the second rail of the slide rail assembly in FIG. 4, showing the configuration between a fixing member, a protrusion portion, and an actuating member.

As shown in FIG. 5, the fixing member 98 comprises a contact section 102 corresponding in position to the protrusion portion 104 of the second rail 24. The actuating member 100 is movably connected to the longitudinally extending body 56 of the second rail 24. Preferably, the actuating member 100 is rotatably connected to the longitudinally extending body 56 of the second rail 24 by means of a second connection member 106. The actuating member 100 comprises a main body 108, a contact portion 110, and a tail portion 112.

The contact portion 110 may be, for example, a protrusion perpendicularly protruding from the main body 108 to contact and be guided by the guiding portion 78 of the longitudinally extending body 42 of the first rail 22, but the form of the contact portion 110 is not limited thereto. Preferably, the tail portion 112 of the actuating member 100 longitudinally extends from the main body 108, but the present invention is not limited thereto. The tail portion 112 of the actuating member 100 is located between the contact section 102 of the fixing member 98 and the protrusion portion 104 of the second rail 24. In addition, one of the upper wall 52 and the lower wall 54 of the second rail 24 comprises an indention portion 114, wherein the indention portion 114 comprises a slant 116.

Figure 6:
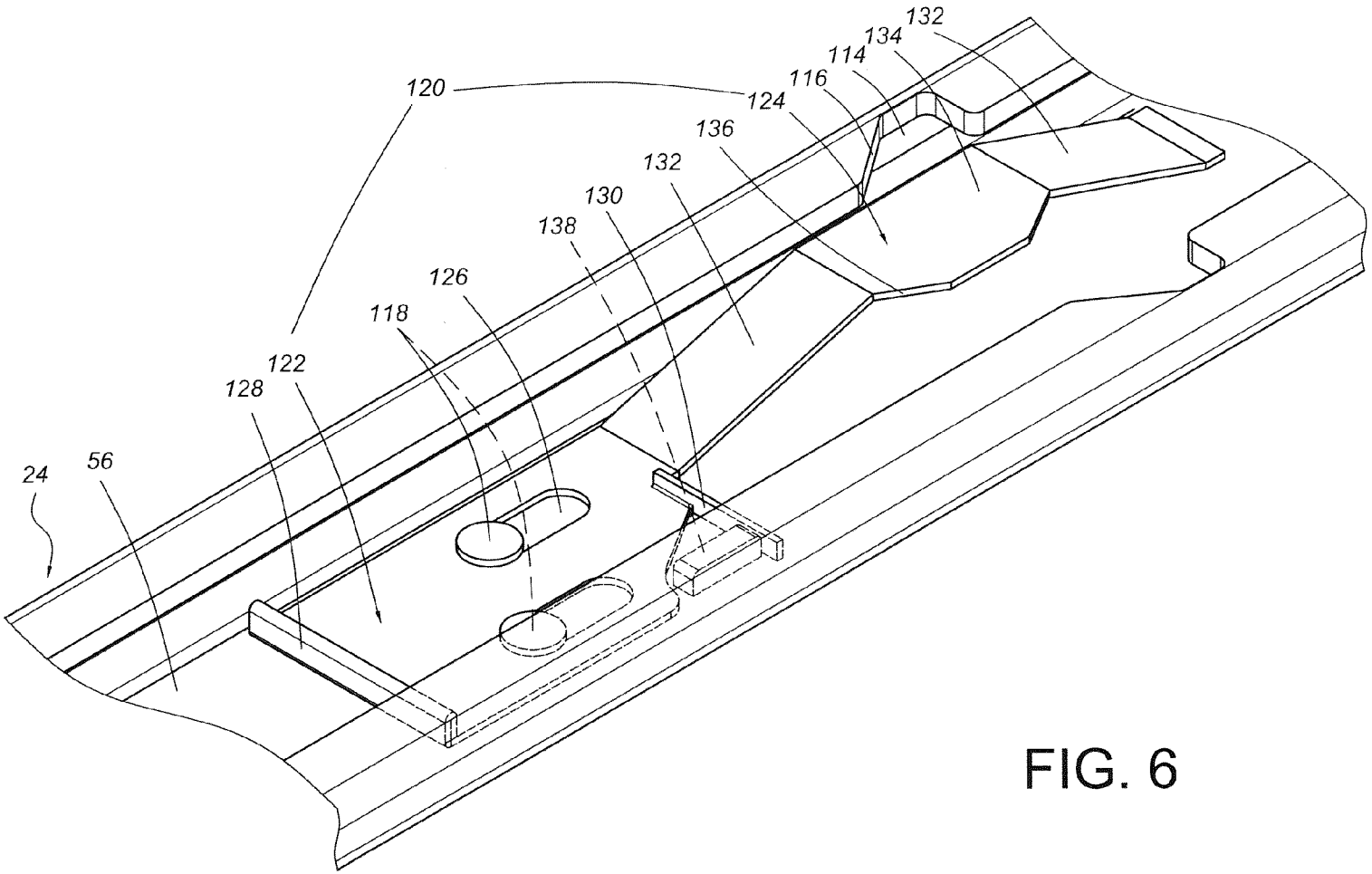
FIG. 6 is a detailed schematic view of another portion of the second rail of the slide rail assembly in FIG. 4, showing a releasing member mounted to the second rail and adjacent to an indention portion of the second rail.

As shown in FIG. 4 and FIG. 6, the slide rail assembly 20 further comprises at least one restricting member 118 and a releasing member 120, wherein the restricting member 118 is attached to the second rail 24 and the releasing member 120 is mounted to the longitudinally extending body 56 of the second rail 24. The releasing member 120 is adjacent to the indention portion 114 of the second rail 24.

The releasing member 120 comprises a moving portion 122 and a disengaging portion 124 extending from the moving portion 122. One of the moving portion 122 and the disengaging portion 124 comprises at least one longitudinal groove 126 corresponding to the at least one restricting member 118, an operating portion 128 connected to one of the moving portion 122 and the disengaging portion 124, and a flexible member 130 connected to one of the moving portion 122 and the disengaging portion 124. In a preferred embodiment, the at least one longitudinal groove 126 is disposed on the moving portion 122, the operating portion 128 is connected to the moving portion 122, and the flexible member 130 is laterally connected to the moving portion 122, but the present invention is not limited thereto. Moreover, by means of the structural configuration of the restricting member 118 and the longitudinal groove 126, the releasing member 120 is longitudinally movable with respect to the restricting member 118 when the operating portion 128 is longitudinally operated. Preferably, the restricting member 118 is disposed within the longitudinal groove 126 so that the movement of the moving portion 122 can be stopped once either end of the longitudinal groove 126 contacts the restricting member 118 (as in FIG. 6).

The disengaging portion 124 comprises at least one slant plate 132 and a flat plate 134 connected to the slant plate 132. In a preferred embodiment, there are two slant plates 132 and the flat plate 134 is connected between the two slant plates 132, wherein one of the two slant plates 132 is connected to the moving portion 122 and bends from the moving portion 122 by an angle, but the present invention is not limited thereto. The flat plate 134 comprises a disengaging edge 136. The longitudinally extending body 56 of the second rail 24 further comprises a blocking member 138, wherein a portion of the flexible member 130 can be correspondingly pressed against the blocking member 138. In more detail, the flexible member 130 is an elongated plate extending from the moving portion 122 of the releasing member 120.

Figure 7:
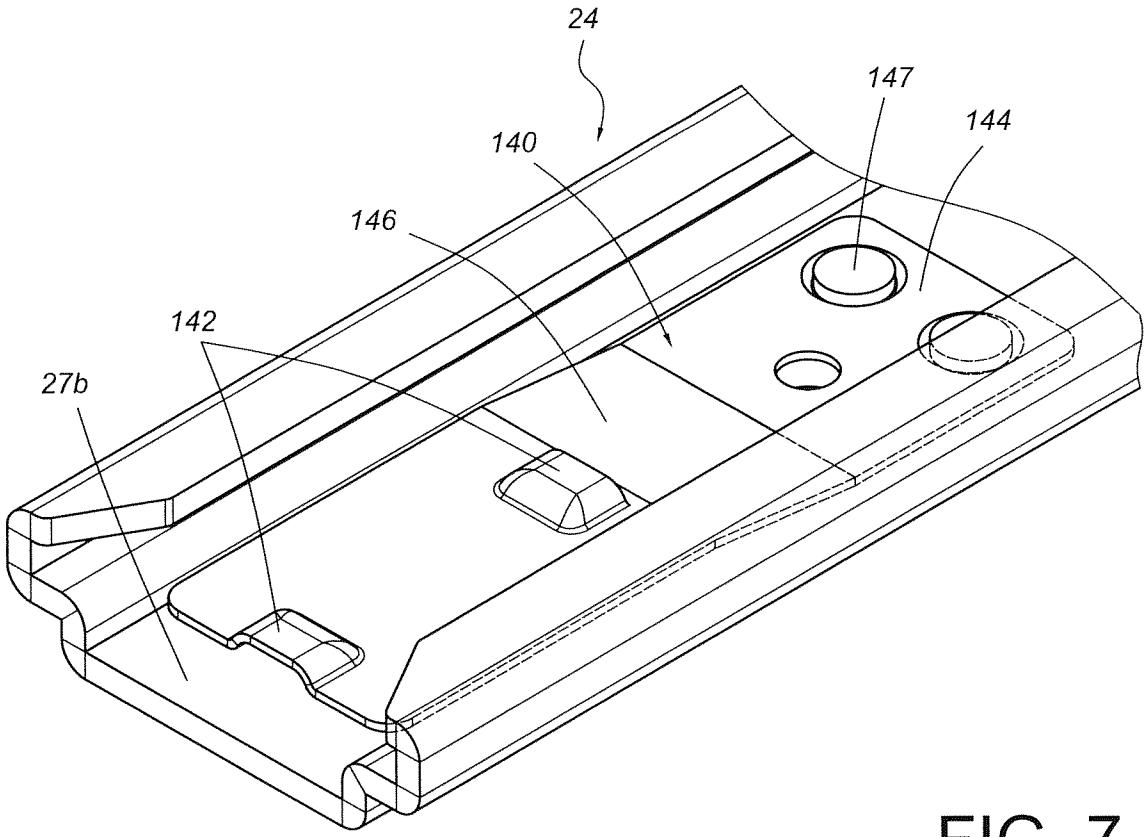
FIG. 7 is a detailed schematic view of still another portion of the second rail of the slide rail assembly in FIG. 4, showing an engaging member mounted adjacent to a second end portion of the second rail.

As shown in FIG. 4 and FIG. 7, the slide rail assembly 20 further comprises an engaging member 140 adjacent to the second end portion 27*b* of the second rail 24, wherein the engaging member 140 comprises at least one positioning portion 142. It is noted that the positioning portion 142 may be a protruding post, but the present invention is not limited thereto; for example, the positioning portion 142 also may be other types of protrusion. Preferably, there are two positioning portions 142. Moreover, in a preferred embodiment, the engaging member 140 comprises a base plate 144 and an elastic portion 146. The elastic portion 146 bends from the base plate 144 and thus is able to provide an elastic force. The base plate 144 may be mounted on the second rail 24 by means of at least one connection member 147, wherein the connection member 147 may be integrated on the second rail 24, but the present invention is not limited thereto; for example, the connection member 147 also may be an independent component mounted on the second rail 24. The positioning portion 142 is located adjacent to the elastic portion 146.

Figure 8:
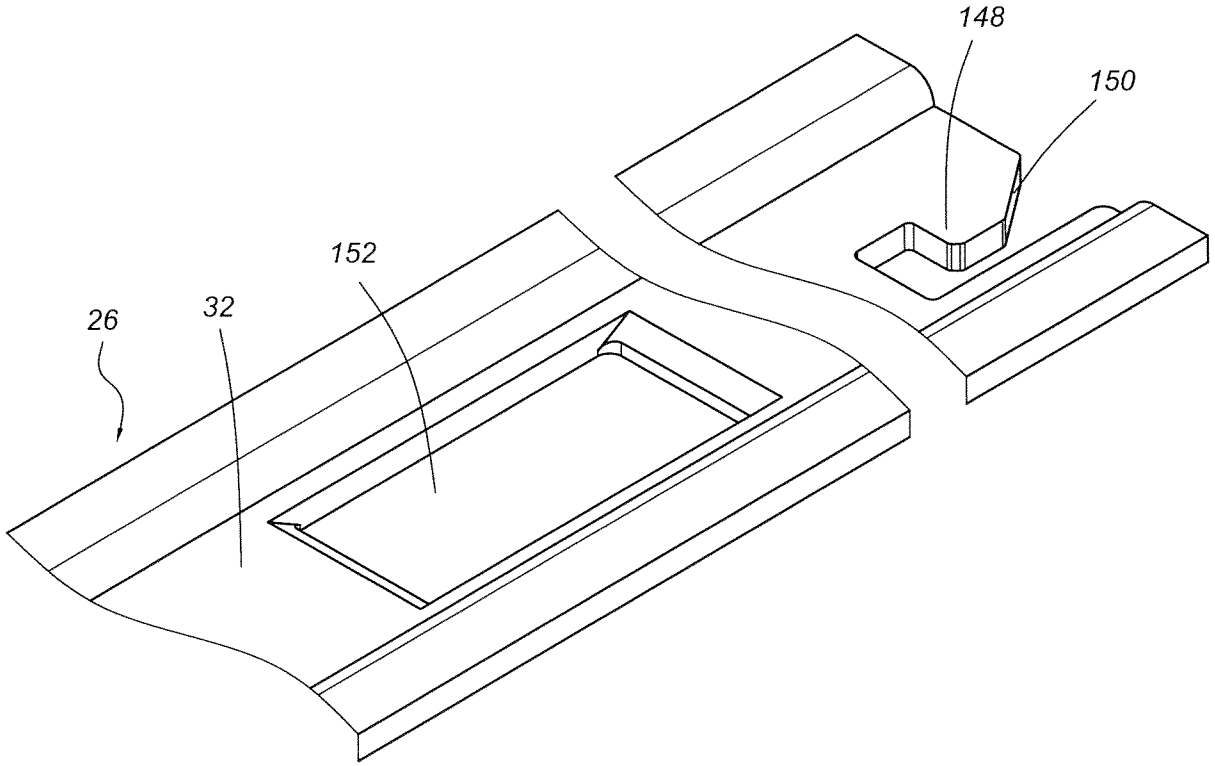
FIG. 8 is a detailed schematic view of a portion of the third rail of the slide rail assembly in FIG. 4, showing a hook portion and a guiding slant.

As shown in FIG. 4 and FIG. 8, the third rail 26 is longitudinally and movably connected to the second rail 24. More specifically, the third rail 26 is received in and movable along the second longitudinal channel 29 of the second rail 24. The third rail 26 comprises an upper wall 70 and a lower wall 72 in addition to the first longitudinal portion 32 and the second longitudinal portion 34, wherein the first longitudinal portion 32 and the second longitudinal portion 34 extend between the upper wall 70 and the lower wall 72.

The first longitudinal portion 32 of the third rail 26 comprises a hook portion 148. In a preferred embodiment, the third rail 26 further comprises a guiding slant 150 adjacent to the hook portion 148, wherein the hook portion 148 is configured to engage with the contact portion 110 of the actuating member 100. The third rail 26 further comprises an opening 152. In a preferred embodiment, the opening 152 is located at the first longitudinal portion 32 of the third rail 26, but the present invention is not limited thereto.

In addition, as shown in FIG. 3 and FIG. 4, the operating member 30 is connected to the third rail 26. In a preferred embodiment, the operating member 30 comprises a base plate portion 31 connected to the second longitudinal portion 34 of the third rail 26, an elastic plate 33 bending from the base plate portion 31 and for providing an elastic force, and a handle portion 37 connected to the elastic plate 33. The elastic plate 33 comprises an engaging portion 39 corresponding to the fixing portion 43 of the first rail 22. The engaging portion 39 is a protrusion and the fixing portion 43 of the first rail 22 is a hole in the illustrative embodiment here; however, the fixing portion 43 of the first rail 22 may be a protrusion and the engaging portion 39 may be a hole in another embodiment not shown. Accordingly, when the third rail 26 is retracted back to a retracted position with respect to the first rail 22 (as in FIG. 1), the engaging portion 39 of the operating member 30 engages with the fixing portion 43 of the first rail 22 by the elastic force provided by the elastic plate 33; on the other hand, when the user wishes to move the third rail 26 along the extending direction, the elastic plate 33 may be slightly bent by means of the elasticity of the elastic plate 33 to disengage the engaging portion 39 from the fixing portion 43 of the first rail 22, thus allowing the user to move the third rail 26 along the extending direction by means of the handle portion 37 of the operating member 30.

FIG. 9A to FIG. 13 are schematic views of the operation of the slide rail assembly 20.

Figure 9A:
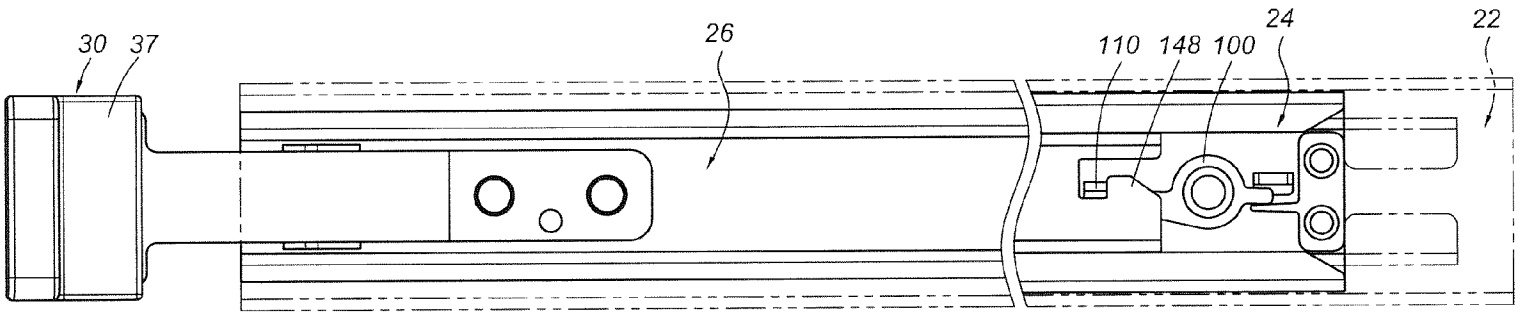
FIG. 9A schematically shows that the third rail of the slide rail assembly in accordance with an embodiment of the present invention engages with a contact portion of the actuating member by means of the hook portion.
Figure 9B:
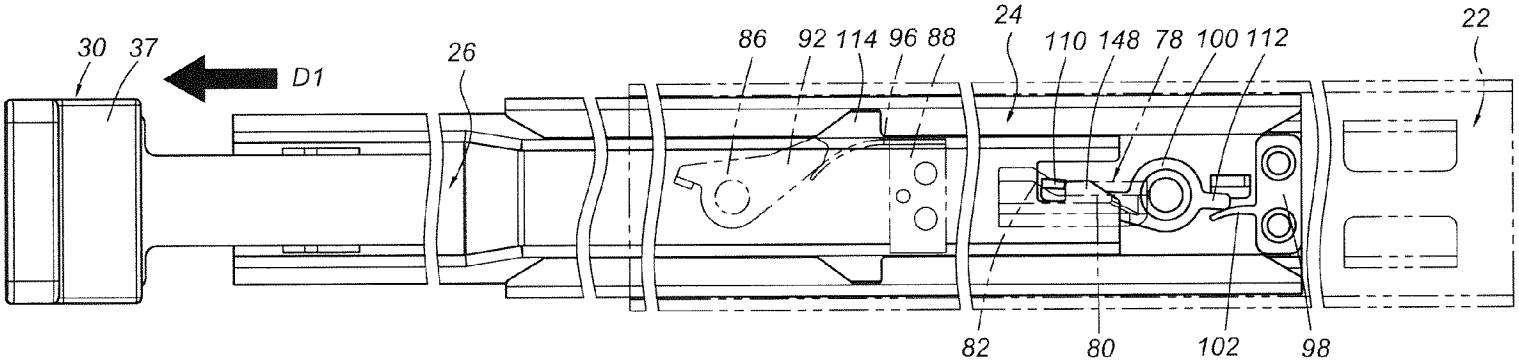
FIG. 9B schematically shows that the second rail of the slide rail assembly in accordance with an embodiment of the present invention is synchronously moved along with the third rail by means of the contact portion of the actuating member engaging with the hook portion.
Figure 9C:
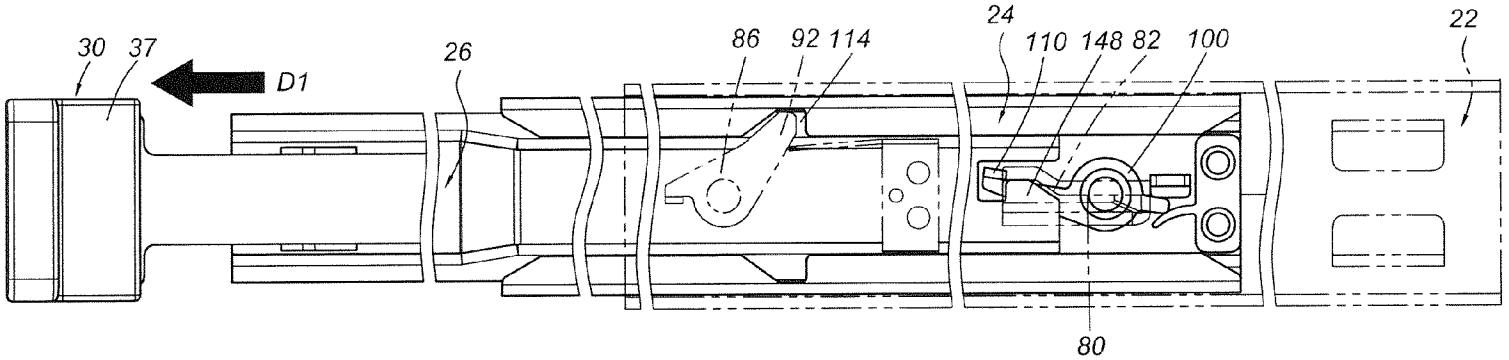
FIG. 9C schematically shows that the second rail of the slide rail assembly in accordance with an embodiment of the present invention is moved to a position and the contact portion of the actuating member is guided by a guiding portion of the first rail to disengage from the hook portion of the third rail.
Figure 9D:
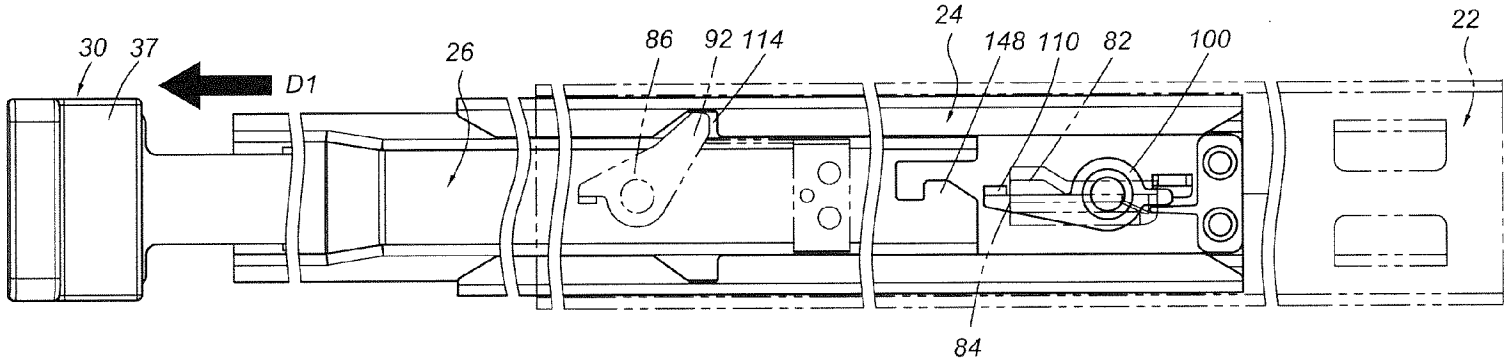
FIG. 9D schematically shows that the second rail of the slide rail assembly in accordance with an embodiment of the present invention is moved to a predetermined position and the contact portion of the actuating member is blocked by a blocking wall of the guiding portion of the first rail.
Figure 10:
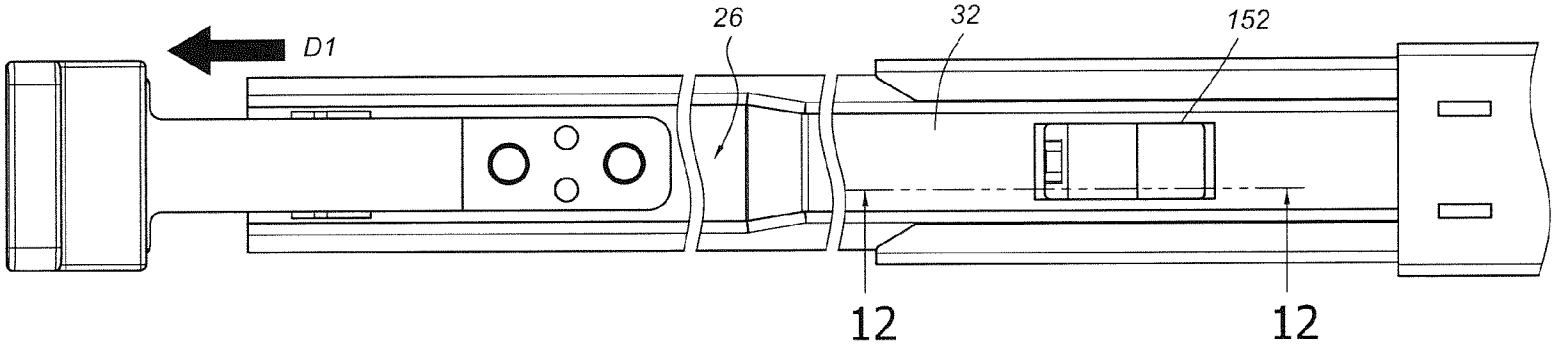
FIG. 10 schematically shows that the third rail of the slide rail assembly in accordance with an embodiment of the present invention is moved along an extending direction.
Figure 11:
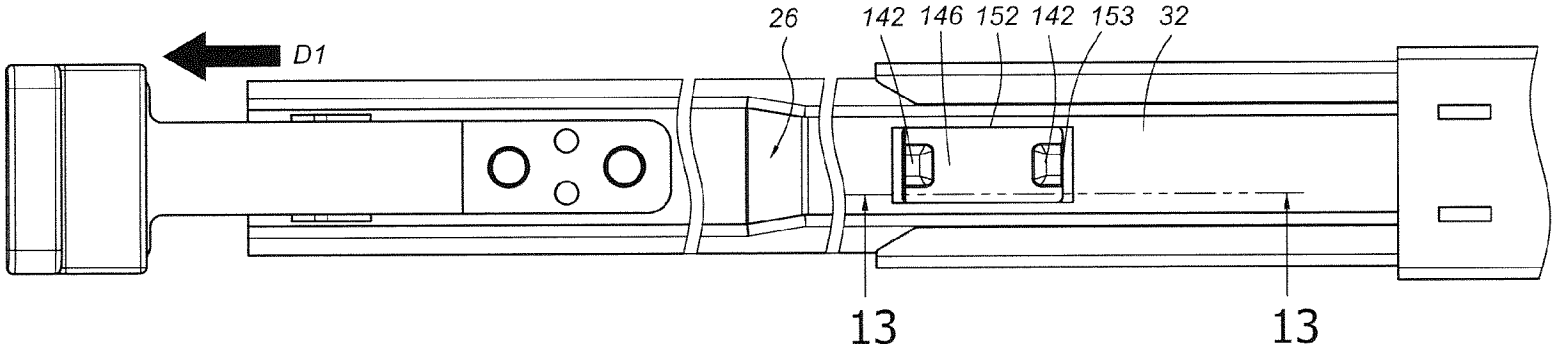
FIG. 11 schematically shows that the third rail of the slide rail assembly in accordance with an embodiment of the present invention is further moved along the extending direction so that an opening of the third rail corresponds to the engaging member.
Figure 12:
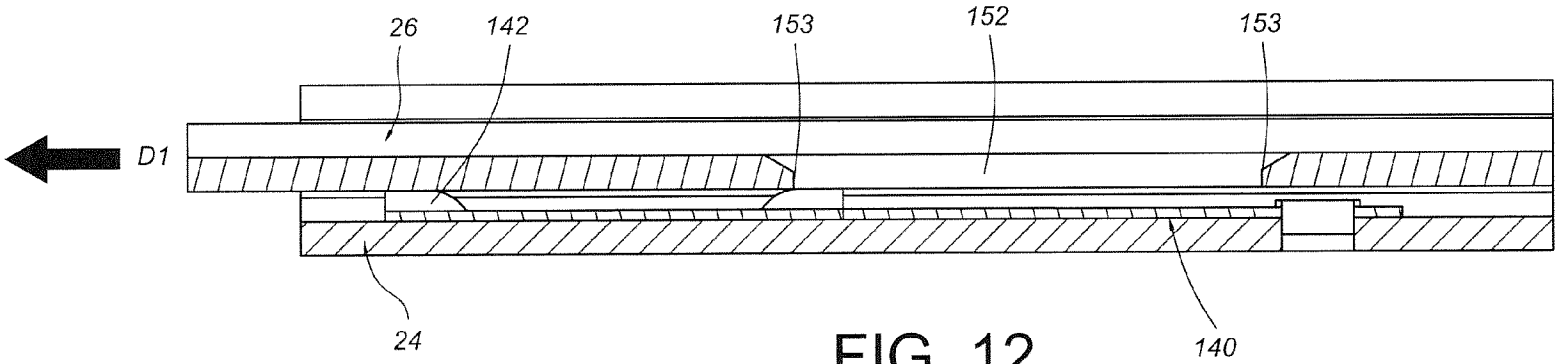
FIG. 12 is a cross-section view taken along the line 12-12 of FIG. 10.
Figure 13:
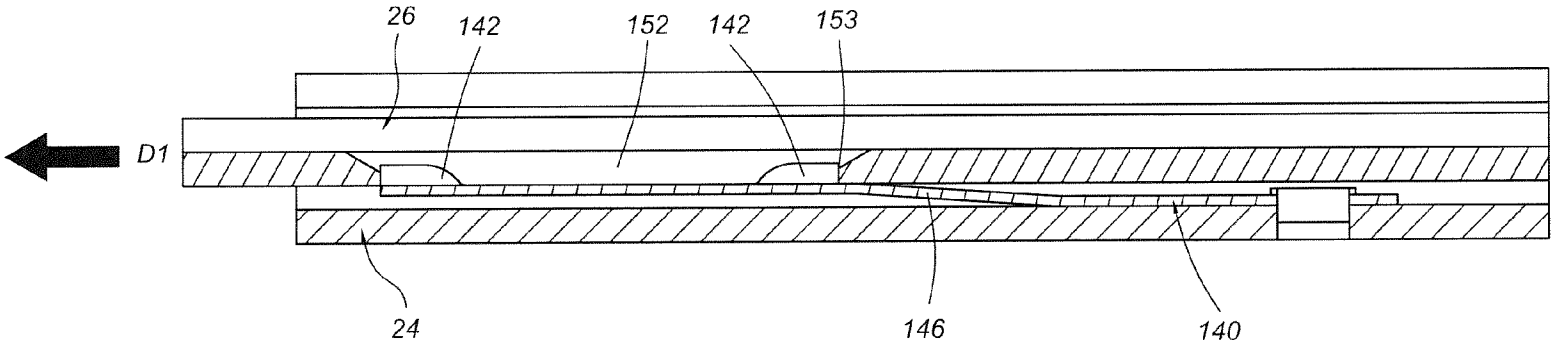
FIG. 13 is a cross-section view taken along the line 13-13 of FIG. 11.

As shown in FIG. 9A to FIG. 9D, when the user pulls the third rail 26, by means of the handle portion 37 of the operating member 30, along an extending direction D1 with respect to the first rail 22 with the contact portion 110 of the actuating member 100 correspondingly engaging with the hook portion 148 of the third rail 26 (as in FIGS. 9A and 9B), the second rail 24 is synchronously moved along with the third rail 26; however, when the second rail 24 is moved to a predetermined position with respect to the first rail 22, the contact portion 110 of the actuating member 100 is correspondingly guided by the guiding portion 78 of the first rail 22 and finally disengaged from the hook portion 148 of the third rail 26 (as in FIGS. 9C and 9D). Specifically, the contact portion 110 of the actuating member 100 is guided by the horizontal section 80 of the guiding portion 78 and then moved upward along the inclining section 82 of the guiding portion 78; wherein when the contact portion 110 of the actuating member 100 is moved along the inclining section 82, the actuating member 100 rotates by an angle by means of the tail portion 112 pressing against the contact section 102 of the fixing member 98 (as in FIG. 9B). Subsequently, the contact portion 110 of the actuating member 100 is moved to a distal edge of the inclining section 82 and thus lifted to disengage from the hook portion 148 of the third rail 26 (as in FIG. 9C). Preferably, at least one of the tail portion 112 of the actuating member 100 and the contact section 102 of the fixing member 98 is of flexible materials to facilitate rotation of the actuating member 100, thus allowing the contact portion 110 of the actuating member 100 to disengage from the hook portion 148 of the third rail 26 smoothly. Consequently, the contact portion 110 of the actuating member 100 is completely separated from the third rail 26 and blocked by the blocking wall 84 of the guiding portion 78 (as in FIG. 9D) when the third rail 26 is further pulled along the extending direction D1.

Moreover, as shown in FIG. 9B and FIG. 9C, the leg portion 92 of the swinging member 86 is guided into the indention portion 114 of the second rail 24 (as in FIG. 9B) and then pressed against the indention portion 114 of the second rail 24 (as in FIG. 9C) in response to the elastic force generated by the elastic guiding portion 96 of the assisting member 88. In other words, the leg portion 92 of the swinging member 86 is engaged with the indention portion 114 of the second rail 24. As such, the second rail 24 is positioned with respect to the first rail 22.

As shown in FIG. 9D, as the contact portion 110 of the actuating member 100 is blocked by the blocking wall 84 of the guiding portion 78 of the first rail 22 and the leg portion 92 of the swinging member 86 is engaged with the indention portion 114 of the second rail 24, the second rail 24 is no longer synchronously moved along with the third rail 26. However, the third rail 26 may continue to move along the extending direction D1.

As shown in FIG. 10 to FIG. 13, as the third rail 26 continues to move along the extending direction D1, the elastic portion 146 of the engaging member 140 that is capable of bending elastically is pressed between the second rail 24 and the third rail 26 and is in an elastic force accumulation state (as in FIG. 10 and FIG. 12) before the third rail 26 moves to an extended position. Once the third rail 26 further moves to the extended position, the elastic portion 146 releases the elastic force so that the positioning portion 142 of the engaging member 140 enters the opening 152 of the first longitudinal portion 32 of the third rail 26 and is engaged with an opening edge 153 of the opening 152 (as in FIG. 11 and FIG. 13).

Figure 14:
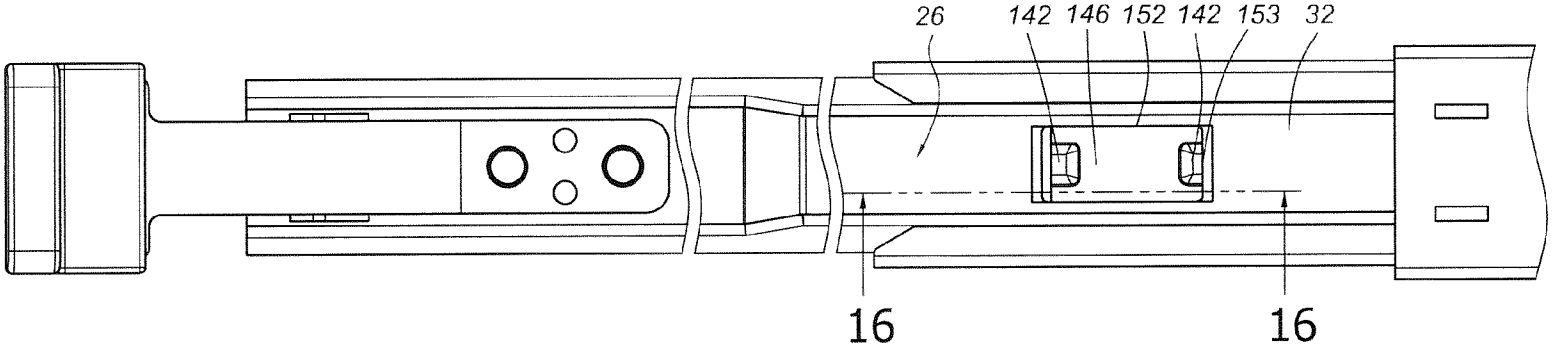
FIG. 14 schematically shows that the third rail of the slide rail assembly in accordance with an embodiment of the present invention is at an extended position.
Figure 15:
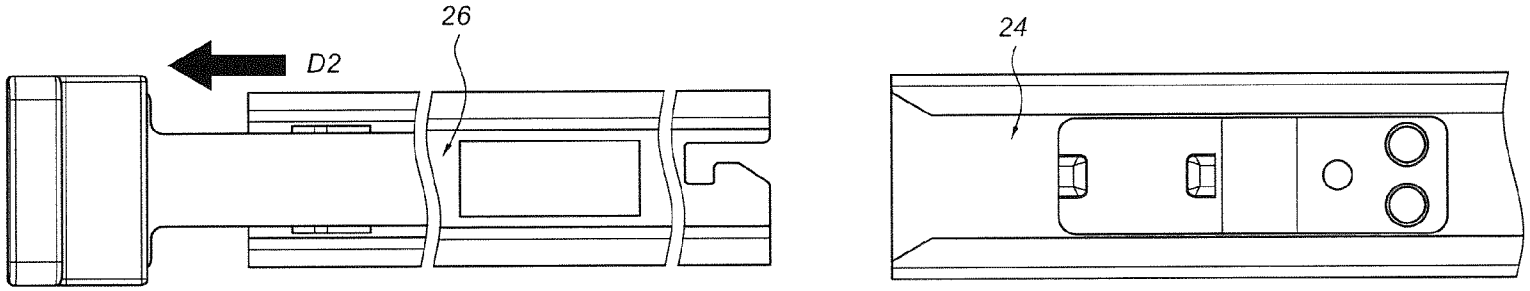
FIG. 15 schematically shows that the third rail of the slide rail assembly in accordance with an embodiment of the present invention is dismounted.
Figure 16:
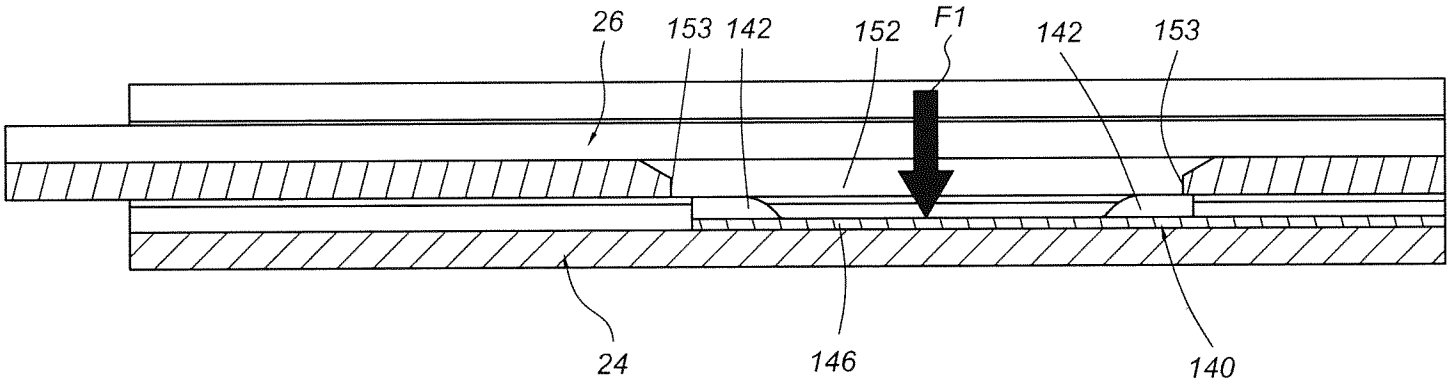
FIG. 16 is a cross-section view taken along the line 16-16 of FIG. 14, showing that a force is applied to an elastic portion of the engaging member.
Figure 17A:
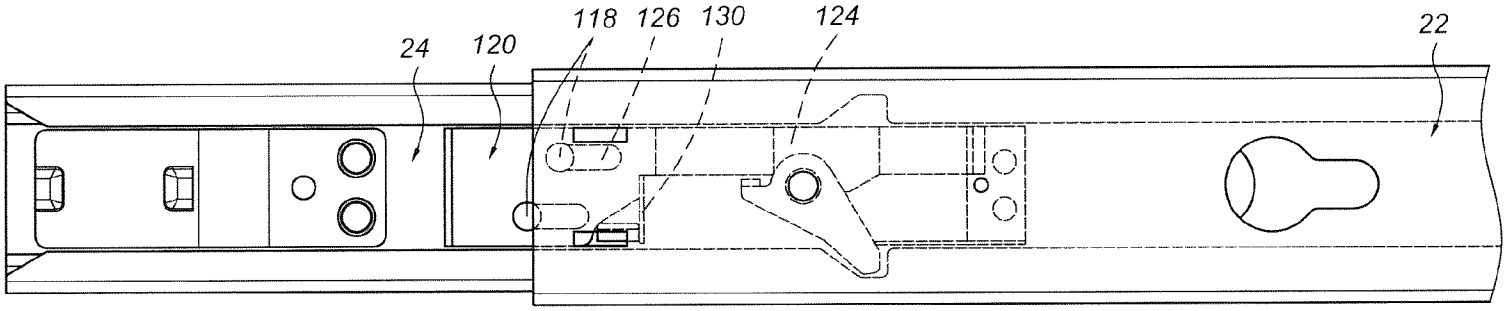
FIG. 17A schematically shows that the second rail of the slide rail assembly in accordance with an embodiment of the present invention is extended from the first rail.
Figure 17B:
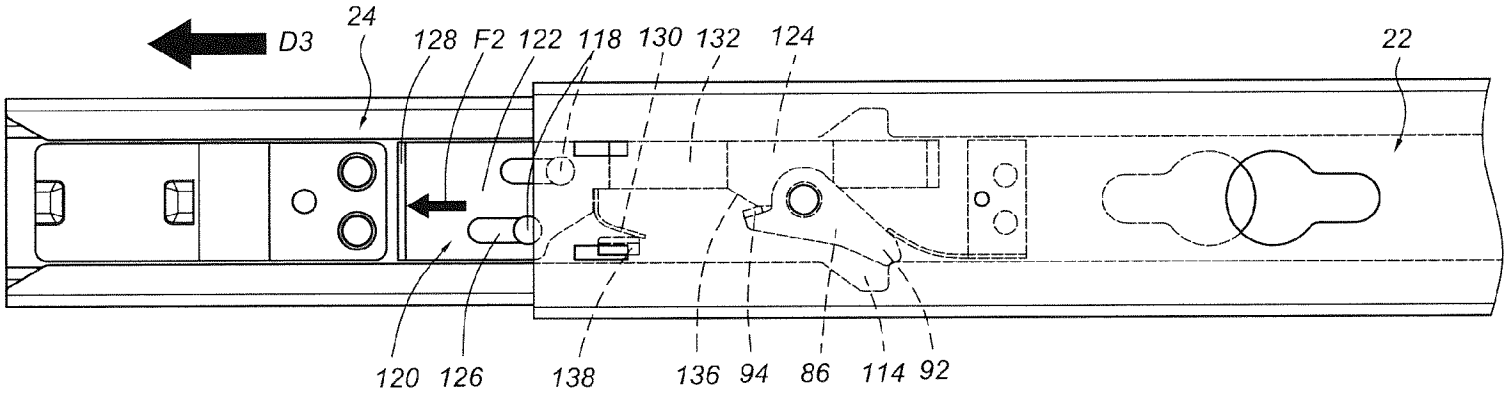
FIG. 17B schematically shows that the releasing member of the slide rail assembly in accordance with an embodiment of the present invention is moved to disengage a leg portion of a swinging member from the indention portion of the second rail.
Figure 17C:
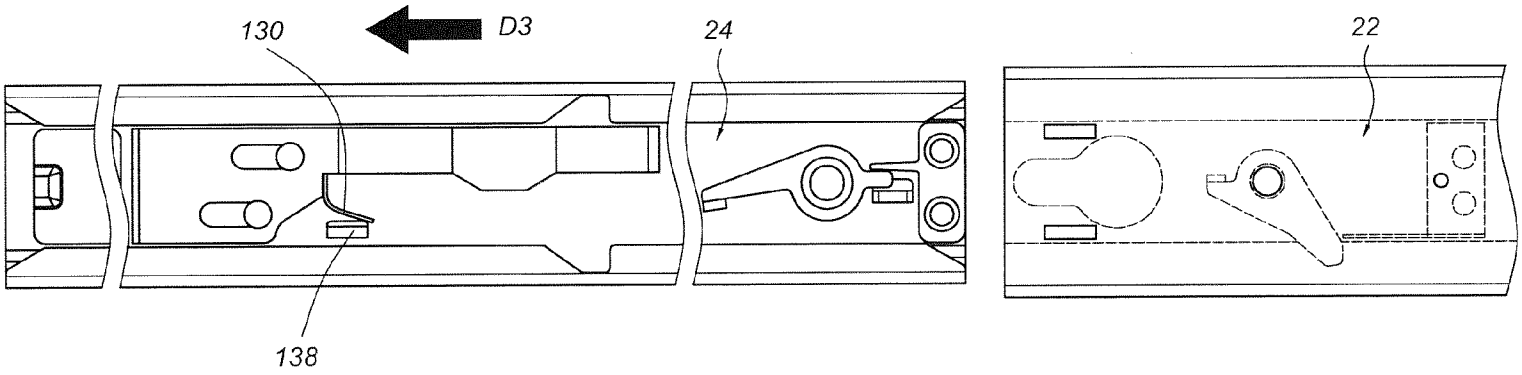
FIG. 17C schematically shows that the second rail of the slide rail assembly in accordance with an embodiment of the present invention is dismounted from the first rail.
Figure 17D:
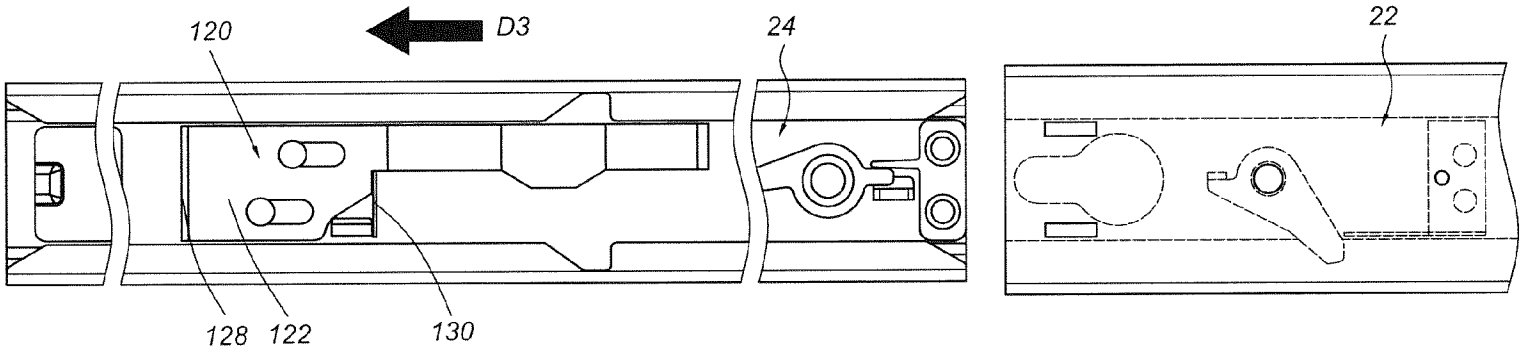
FIG. 17D schematically shows that the second rail of the slide rail assembly in accordance with an embodiment of the present invention is dismounted from the first rail and a flexible member then moves the releasing member to return to the initial state.

As shown in FIG. 14 to FIG. 16, to dismount the third rail 26 from the second rail 24 when the third rail 26 is at the extended position, the user may apply a force F1 from the opening 152 of the third rail 26 to the elastic portion 146 of the engaging member 140 (as in FIG. 16) so that the positioning portion 142 of the elastic portion 146 is separated from the opening 152 and no longer engages with the opening edge 153. As such, the third rail 26 may be drawn in a dismounting direction D2 (as in FIG. 15) to dismount the third rail 26 from the second rail 24.

As shown in FIG. 17A to FIG. 17D, after the third rail 26 is dismounted, the user may further dismount the second rail 24 from the first rail 22. The user may apply a force F2 (as in FIG. 17B) to pull the operating portion 128 of the releasing member 120 so that the moving portion 122 of the releasing member 120 moves with respect to the restricting member 118 by means of the longitudinal groove 126. As such, the disengaging portion 124 of the releasing member 120 is driven to move along with the moving portion 122 so that the disengaging edge 136 correspondingly presses against a portion of the swinging member 86 (such as the extended side portion 94) to disengage the leg portion 92 of the swinging member 86 from the indention portion 114 of the second rail 24 (meanwhile, the flexible member 130 is bent by the force applied from the blocking member 138). As such, the second rail 24 may be drawn in a dismounting direction D3 to dismount the second rail 24 from the first rail 22 (as in FIG. 17C). The flexible member 130 returns the releasing member 120 to its initial state (as in FIG. 17D) once the user ceases applying the force F2 to the operating portion 128.

As illustrated in FIG. 14 to FIG. 17D, the third rail 26 and the second rail 24 of the slide rail assembly 20 may both be dismounted so that the user may carry out replacement of the chassis (such as a server chassis) or replacement or maintenance of the slide rail assembly 20.

Figure 18A:
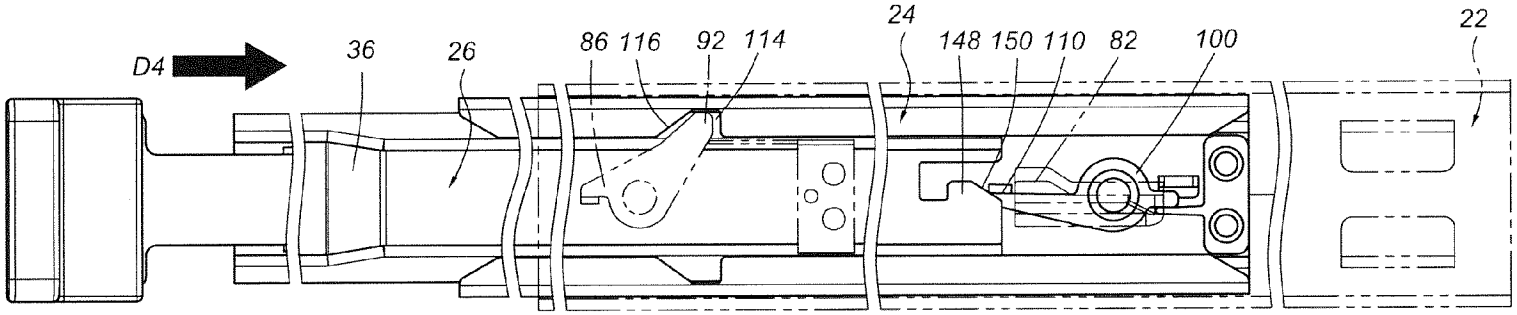
FIG. 18A schematically shows that the third rail of the slide rail assembly in accordance with an embodiment of the present invention is moved along a retracting direction and the guiding slant of the third rail lifts the contact portion of the actuating member.
Figure 18B:
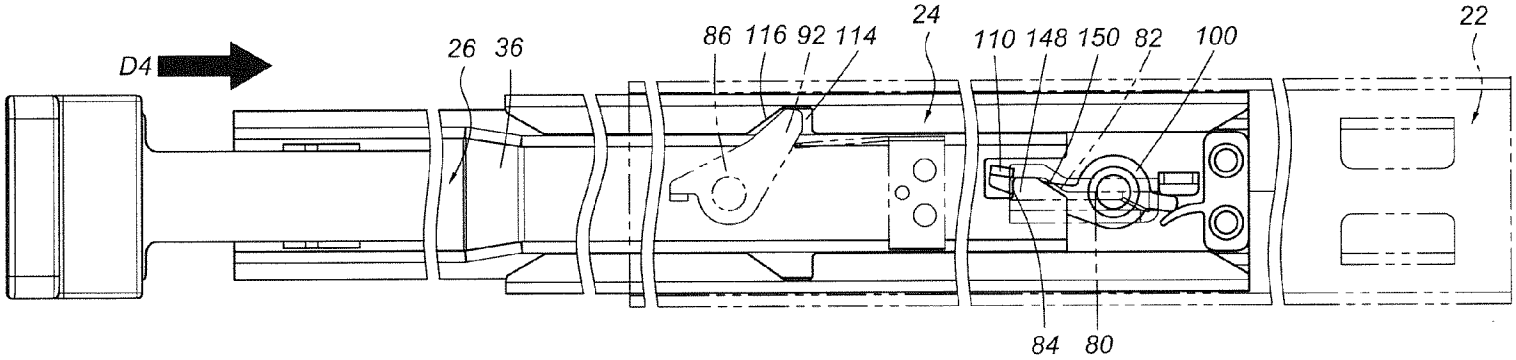
FIG. 18B schematically shows that the guiding slant of the third rail of the slide rail assembly in accordance with an embodiment of the present invention lifts and moves the contact portion of the actuating member away from the blocking wall of the guiding portion of the first rail.
Figure 18C:
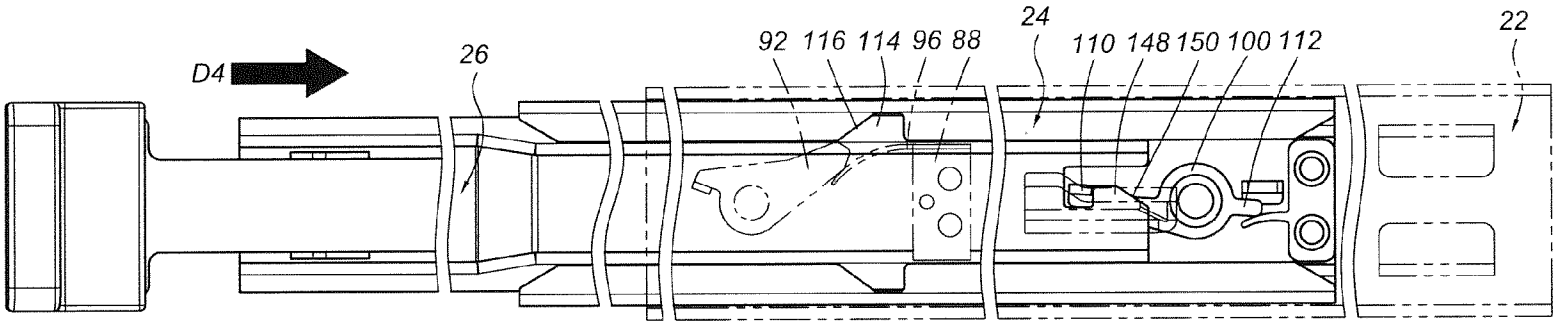
FIG. 18C schematically shows that the third rail of the slide rail assembly in accordance with an embodiment of the present invention is further moved along the retracting direction and the leg portion of the swinging member is thereby driven to leave the indention portion of the second rail by the slant.

Moreover, as shown in FIG. 18A to FIG. 18C, to retract the third rail 26 from the extended position (as in FIG. 11) along a retracting direction D4, the user may apply a force to press the elastic portion 146 of the engaging member 140 (as in FIG. 16) again and simultaneously push the third rail 26 along the retracting direction D4 so that the slant portion 36 of the third rail 26 may press against the second rail 24, thus allowing the third rail 26 and the second rail 24 to be retracted with respect to the first rail 22. When the second rail 24 is moved to a position, the guiding slant 150 of the hook portion 148 of the third rail 26 correspondingly lifts the contact portion 110 of the actuating member 100 so that the contact portion 110 of the actuating member 100 is moved away from the blocking wall 84 and back to the distal edge of the inclining section 82 of the guiding portion 78 of the first rail 22 (as in FIG. 18B). Furthermore, the slant 116 of the second rail 24 presses against the leg portion 92 of the swinging member 86 so that the leg portion 92 deviates and finally disengages from the indention portion 114 (as in FIG. 18C). As such, the contact portion 110 of the actuating member 100 may be guided by the guiding portion 78 of the first rail 22 again and moved back to engage with the hook portion 148 of the third rail 26, so that third rail 26 and the second rail 24 may be retracted to a retracted state with respect to the first rail 22 (as in FIG. 9A).

While the invention has been described by way of example and in terms of the preferred embodiments, it is to be understood that the invention is not limited to the disclosed embodiments. Therefore, the scope of the appended claims should be accorded the broadest interpretation so as to encompass all such modifications and similar arrangements.

The invention claimed is:

1. A slide rail assembly, comprising:

a first rail, comprising a guiding portion;

a second rail, longitudinally and movably connected to the first rail;

an actuating member, movably connected to the second rail and comprising a contact portion; and a third rail, longitudinally and movably connected to the second rail and comprising a hook portion, wherein when the third rail is pulled with respect to the first rail with the contact portion of the actuating member engaging with the hook portion of the third rail, the second rail is synchronously moved along with the third rail, and wherein when the second rail is moved to a predetermined position with respect to the first rail, the actuating member rotates by an angle by guiding means of the guiding portion of the first rail and thereby disengages the contact portion of the actuating member from the hook portion of the third rail;

wherein the guiding portion of the first rail comprises a horizontal section and an inclining section extending from the horizontal section, and wherein when the second rail is moved to the predetermined position with respect to the first rail, the actuating member is guided from the horizontal section to the inclining section and thereby rotates by the angle to disengage the contact portion of the actuating member from the hook portion of the third rail.

2. The slide rail assembly as claimed in claim 1, wherein the guiding portion further comprises a blocking wall adjacent to the inclining section to further block the contact portion of the actuating member after the actuating member is guided from the horizontal section to the inclining section.

3. A slide rail assembly, comprising:

a first rail, comprising an upper wall, a lower wall, and a longitudinally extending body extending between the upper wall and the lower wall of the first rail, wherein the longitudinally extending body of the first rail comprises a guiding portion, and wherein the guiding portion comprises a horizontal section, an inclining section extending from the horizontal section, and a blocking wall adjacent to the inclining section;

a second rail, longitudinally and movably connected to the first rail and comprising an upper wall, a lower wall, a longitudinally extending body extending between the upper wall and the lower wall of the second rail, and a protrusion portion located at the longitudinally extending body of the second rail, wherein one of the upper wall and the lower wall of the second rail comprises an indention portion;

a fixing member, connected to the second rail and comprising a contact section corresponding to the protrusion portion of the second rail;

an actuating member, movably connected to the second rail and comprising a contact portion and a tail portion, wherein the contact portion corresponds to the guiding portion of the first rail and the tail portion is located between the contact section of the fixing member and the protrusion portion of the second rail;

a third rail, longitudinally and movably connected to the second rail and comprising a hook portion corresponding to the contact portion of the actuating member, wherein when the third rail is moved along an extending direction with the contact portion of the actuating member correspondingly engaging with the hook portion of the third rail, the second rail is synchronously moved along with the third rail, wherein when the second rail is moved to a position corresponding to the guiding portion of the first rail, the contact portion of the actuating member is successively guided by the horizontal section and the inclining section of the guiding portion of the first rail, and wherein when the contact portion of the actuating member is guided by the inclining section, the actuating member rotates by means of the tail portion pressing against the contact section of the fixing member so that the contact portion of the actuating member disengages from the hook portion of the third rail and is then guided to and blocked by the blocking wall of the guiding portion; and a swinging member, movably connected to the longitudinally extending body of the first rail and comprising a leg portion corresponding to the indention portion of the second rail, wherein when the second rail is synchronously moved along with the third rail to a predetermined position along the extending direction, the leg portion of the swinging member enters the indention portion of the second rail.

4. The slide rail assembly as claimed in claim 3, wherein the second rail has a first end portion, and wherein the fixing member and the actuating member are adjacent to the first end portion of the second rail.

5. The slide rail assembly as claimed in claim 3, wherein the second rail has a second end portion and the slide rail assembly further comprises an engaging member adjacent to the second end portion of the second rail, and wherein the engaging member comprises a positioning portion and the third rail further comprises an opening corresponding to the positioning portion of the engaging member so that the positioning portion of the engaging member engages with and positions at the opening of the third rail when the third rail moves with respect to the second rail to an extended position.

6. The slide rail assembly as claimed in claim 5, wherein the engaging member comprises a base plate and an elastic portion bending from the base plate, and wherein the positioning portion is located at the elastic portion.

7. The slide rail assembly as claimed in claim 3, further comprising:

at least one restricting member, attached to the second rail; and a releasing member, mounted to the longitudinally extending body of the second rail and adjacent to the indention portion of the second rail, the releasing member comprising a moving portion and a disengaging portion, wherein one of the moving portion and the disengaging portion comprises at least one longitudinal groove corresponding to the at least one restricting member, and wherein the disengaging portion corresponds to a portion of the swinging member, wherein when the moving portion is operated after engagement of the leg portion of the swinging member with the indention portion of the second rail, the disengaging portion is driven to move the portion of the swinging member so that the leg portion of the swinging member is disengaged from the indention portion of the second rail again.

8. The slide rail assembly as claimed in claim 3, wherein the third rail further comprises a guiding slant adjacent to the hook portion, and wherein when the third rail is retracted along a retracting direction, the contact portion of the actuating member is pressed back to engage with the hook portion of the third rail by the guiding slant of the third rail.

9. The slide rail assembly as claimed in claim 8, wherein the indention portion of the second rail comprises a slant, and wherein when the third rail is retracted along the retracting direction, the slant presses against the leg portion of the swinging member so that the leg portion deviates and leaves the indention portion of the second rail.

10. The slide rail assembly as claimed in claim 3, further comprising an operating member connected to the third rail to be operated to move the third rail along the extending direction, wherein the longitudinally extending body of the first rail comprises a fixing portion, wherein the operating member comprises a base plate portion connected to the third rail, an elastic plate bending from the base plate portion for providing an elastic force, and a handle portion connected to the elastic plate, wherein the elastic plate comprises an engaging portion corresponding to the fixing portion of the longitudinally extending body of the first rail, and wherein when the third rail is retracted to a retracted position with respect to the first rail, the engaging portion of the elastic plate engages with the fixing portion by the elastic force provided by the elastic plate.

11. A slide rail assembly, comprising:

a first rail, comprising a guiding portion;

a second rail, longitudinally and movably connected to the first rail;

an actuating member, movably connected to the second rail and comprising a contact portion; and a third rail, longitudinally and movably connected to the second rail and comprising a hook portion, wherein when the third rail is pulled with respect to the first rail with the contact portion of the actuating member engaging with the hook portion of the third rail, the second rail is synchronously moved along with the third rail, and wherein when the second rail is moved to a predetermined position with respect to the first rail, the actuating member rotates by an angle by guiding means of the guiding portion of the first rail and thereby disengages the contact portion of the actuating member from the hook portion of the third rail;

wherein the second rail comprises a protrusion portion and the slide rail assembly further comprises a fixing member connected to the second rail, and wherein the fixing member comprises a contact section corresponding to the protrusion portion of the second rail and the actuating member further comprises a tail portion located between the contact section of the fixing member and the protrusion portion of the second rail.

12. The slide rail assembly as claimed in claim 11, wherein the second rail has a first end portion, and wherein the fixing member and the actuating member are adjacent to the first end portion of the second rail.

13. The slide rail assembly as claimed in claim 11, wherein the second rail has a second end portion and the slide rail assembly further comprises an engaging member adjacent to the second end portion of the second rail, and wherein the engaging member comprises a positioning portion and the third rail further comprises an opening corresponding to the positioning portion of the engaging member, whereby the positioning portion of the engaging member engages with and positions at the opening of the third rail when the third rail moves with respect to the second rail to an extended position.

14. The slide rail assembly as claimed in claim 13, wherein the engaging member comprises a base plate and an elastic portion bending from the base plate, and wherein the positioning portion is located at the elastic portion.

15. A slide rail assembly, comprising:

a first rail, comprising a guiding portion;

a second rail, longitudinally and movably connected to the first rail;

an actuating member, movably connected to the second rail and comprising a contact portion; and a third rail, longitudinally and movably connected to the second rail and comprising a hook portion, wherein when the third rail is pulled with respect to the first rail with the contact portion of the actuating member engaging with the hook portion of the third rail, the second rail is synchronously moved along with the third rail, and wherein when the second rail is moved to a predetermined position with respect to the first rail, the actuating member rotates by an angle by guiding means of the guiding portion of the first rail and thereby disengages the contact portion of the actuating member from the hook portion of the third rail;

a swinging member, pivotally connected to the first rail and comprising a leg portion, wherein the second rail comprises an indention portion for the leg portion to engage with; and an assisting member, comprising an elastic guiding portion contacting the swinging member, wherein when the second rail moves to the predetermined position, the swinging member presses the leg portion against the indention portion of the second rail by an elastic force generated by the elastic guiding portion.

16. The slide rail assembly as claimed in claim 15, further comprising:

at least one restricting member, attached to the second rail; and a releasing member, mounted to the second rail and comprising a moving portion and a disengaging portion, wherein one of the moving portion and the disengaging portion comprises at least one longitudinal groove corresponding to the at least one restricting member, and wherein the disengaging portion corresponds to a portion of the swinging member, wherein when the releasing member is pulled with respect to the at least one restricting member after engagement of the leg portion of the swinging member with the indention portion of the second rail, the swinging member is moved by means of the disengaging portion of the releasing member to disengage the leg portion of the swinging member from the indention portion of the second rail.

* * * * *